US006142688A

United States Patent [19]

Saito

[11] Patent Number: 6,142,688

[45] Date of Patent: Nov. 7, 2000

[54] APPARATUS FOR PRINTING ON ELONGATED MEDIUM TO BE PRINTED

[75] Inventor: Hideo Saito, Ibaraki-ken, Japan

[73] Assignee: Nippon Typewriter Co., Ltd., Tokyo, Japan

[21] Appl. No.: 09/249,121

[22] Filed: Feb. 12, 1999

[30] Foreign Application Priority Data

Feb. 14, 1998 [JP] Japan ..... 10-049010

[51] Int. Cl.[7] ..... B41J 11/26

[52] U.S. Cl. ..... 400/621; 83/355

[58] Field of Search ..... 83/303, 355, 386, 83/861, 862, 864; 101/226; 346/24; 400/593, 621, 621.1, 621.2

[56] References Cited

U.S. PATENT DOCUMENTS 5,066,152 11/1991 Kuzuya et al. .
5,458,423 10/1995 Sims et al. .
5,556,213 9/1996 Kudo et al. .

FOREIGN PATENT DOCUMENTS 5-20893 3/1993 Japan .

*Primary Examiner*—John S. Hilten
*Assistant Examiner*—Darius N. Cone
*Attorney, Agent, or Firm*—Arent Fox Kintner Plotkin & Kahn, PLLC

[57] ABSTRACT

An apparatus for printing on an elongated medium to be printed has a printing head for printing based on printing data, transporting device for transporting the medium relative to the printing head, completely cutting edges for completely cutting the medium on a downstream side of the printing head, as seen in a direction of travelling of the medium, and partially cutting edges partially cutting the medium on the downstream side of the printing head. The apparatus is provided with a completely cutting travelling device so constructed and arranged to be automatically started at a complete cutting position of the medium based on a length contained in the printing data to thereby perform complete cutting of the medium. It is also provided with a partially cutting driving device so constructed and arranged to be automatically started, independent of the completely cutting device, at a partial cutting position.

7 Claims, 5 Drawing Sheets

APPARATUS FOR PRINTING ON ELONGATED MEDIUM TO BE PRINTED

BACKGROUND OF THE INVENTION

1. Field of the Invention

The present invention relates to an apparatus for printing on a continuously elongated medium to be printed such as a tube, a labelling tape, or the like, wherein the apparatus is provided with a partially cutting means (or a half cutting means) for partially cutting the medium while leaving a part thereof uncut or intact, and with a completely cutting means (or a total cutting means) for cutting the entire depth or the thickness of the medium.

2. Description of the Related Art

As this kind of apparatus, there has hitherto been known tape printers which are described in Japanese Published Unexamined Utility Model Registration Application No. 20893/1993, Japanese Published Unexamined Patent Application No. 71955/1994 (which corresponds to U.S. Pat. No. 5,458,423), and Japanese Published Unexamined Patent Application No. 286241/1994 (which corresponds to U.S. Pat. No. 5,556,213). The tape printer which is described in Japanese Published Unexamined Utility Model Registration Application No. 20893/1993 is provided with a first cutting edge for performing a complete cutting work and a second cutting edge for performing a partial cutting work. These cutting edges are operated by the manual operation on the part of an operator. In the tape printer described in Japanese Published Unexamined Patent Application No. 71955/1994, the complete cutting work and the partial cutting work are performed in automatic operations. However, in case the partial cutting work is continuously performed, the switching or changeover must be made by means of a manual changeover lever. Further, in the tape printer disclosed in the Japanese Published Unexamined Patent Application No. 286241/1994, the partial cutting work is performed automatically and the complete cutting work is performed manually to thereby obtain a labelling tape in which the desired printing and partial cutting work are performed.

The above-described conventional tape printers have the following disadvantages. Namely, some are troublesome in that the partial cutting work or the complete cutting work must be manually performed by the operator, and others are complicated in that the changeover must be made by means of the manual changeover lever when partial cutting work is made in a continuous manner. Particularly, in case there are needed a plurality of units of labelling tapes each of the units containing therein a plurality of partially cut labelling tapes, the operator must perform the complete cutting work after having printed one unit containing partially cut labelling tapes and then perform again the printing work of the next unit containing the partially cut labelling tapes. These operations must be repeated until the required units have been finished. This cyclic repetition of the partial cutting work and the complete cutting work is very inconvenient to the operator.

SUMMARY OF THE INVENTION

The present invention is an apparatus for printing on an elongated medium to be printed having: a printing head for printing based on printing data; transporting means for transporting the medium relative to the printing head; completely cutting means having a cutting edge for completely cutting the medium on a downstream side of the printing head, as seen in a direction of travelling of the medium; and partially cutting means having a cutting edge for partially cutting the medium on the downstream side of the printing head. The apparatus comprises completely cutting driving means for driving the completely cutting means, so constructed and arranged to be automatically started at a complete cutting position of the medium based on a length contained in the printing data to thereby perform complete cutting of the medium. The apparatus also comprises partially cutting driving means for driving the partially cutting means, so constructed and arranged to be automatically started, independent of the completely cutting means, at a partial cutting position.

Preferably, the completely cutting driving means comprises a driving source and transmitting means and the partially cutting driving means comprises a driving source and transmitting means. The driving source for the completely cutting drive means and the driving source for the partially cutting drive means are constituted by a common driving source. The apparatus further comprises transmission switchover means for separately driving the completely cutting means and the partially cutting means. The switchover means comprises a cam member. Further, the completely cutting driving means, the partially cutting driving means, and printing head driving means for driving a printing head towards a platen have a common diving source. The completely cutting driving means closes the cutting edge thereof at a time of completion of printing on the medium.

BRIEF DESCRIPTION OF THE DRAWINGS

The above and other objects and the attendant advantages of the present invention will become readily apparent by reference to the following detailed description when considered in conjunction with the accompanying drawings wherein.

DETAILED DESCRIPTION OF A PREFERRED EMBODIMENT

Figure 1:
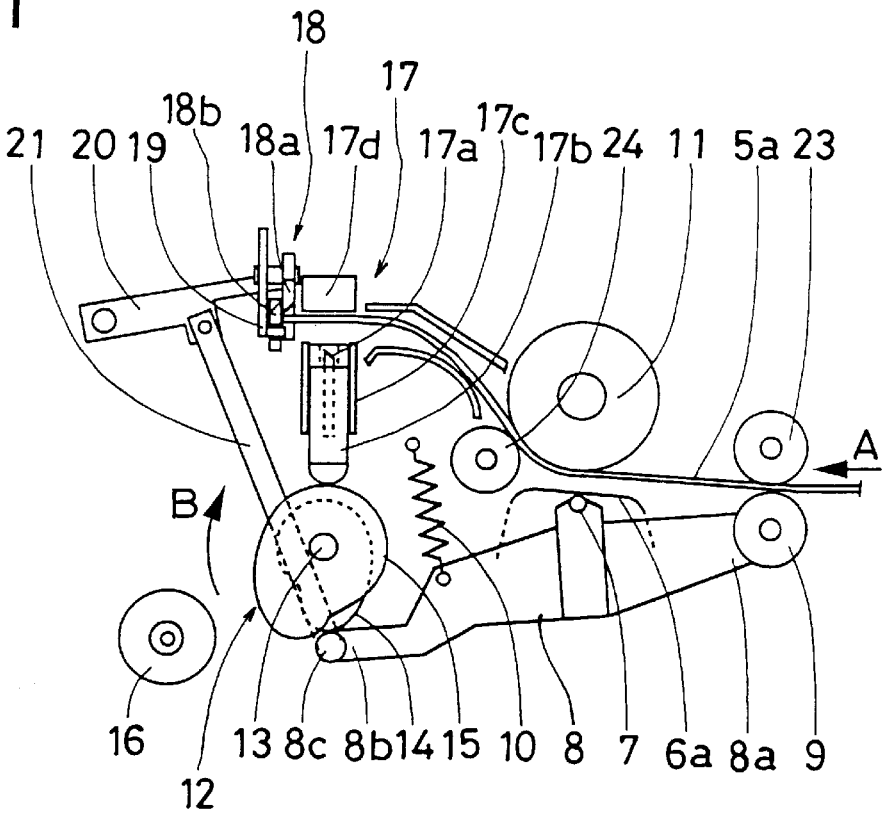
FIG. 1 is an enlarged plan view of a printing portion and a cutting region in a state in which a medium to be printed has been completely cut in a thermal printer.
Figure 2:
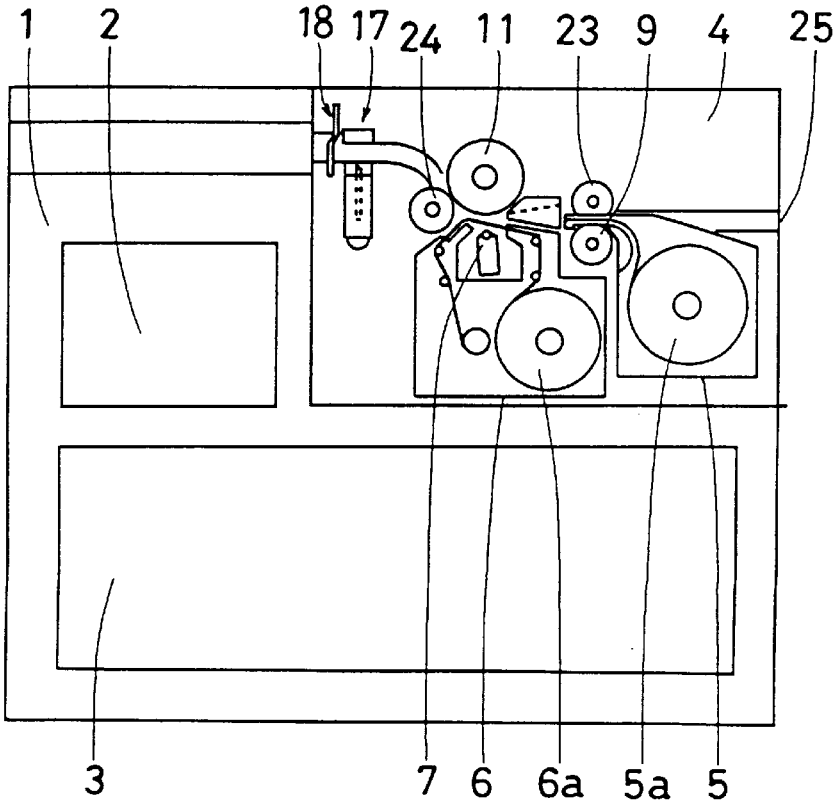
FIG. 2 is an overall plan view of the thermal printer.
Figure 3:
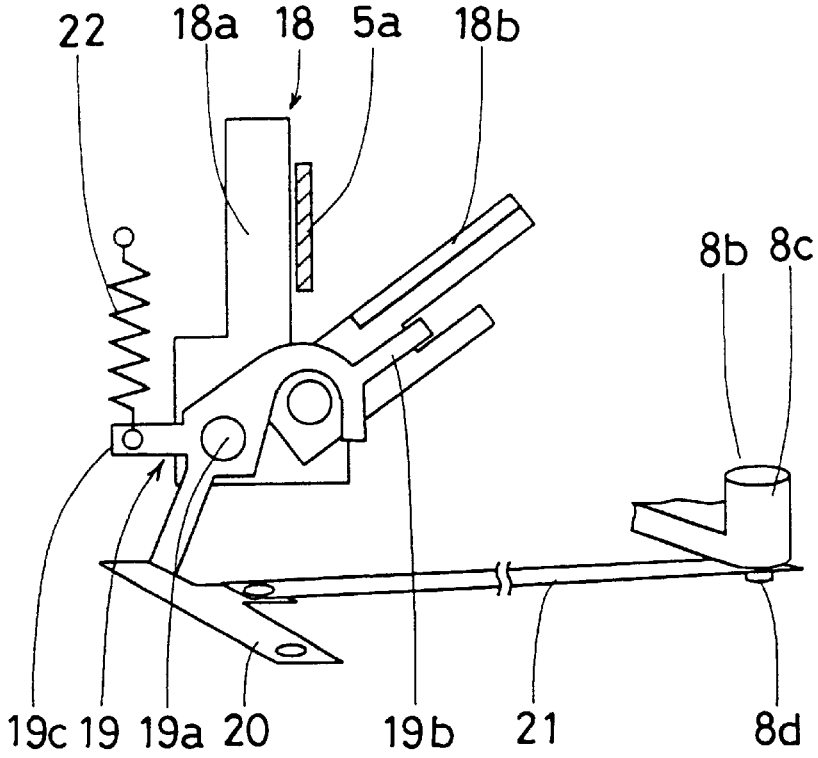
FIG. 3 is a schematic view showing the mechanism of a complete cutting means and a driving mechanism for complete cutting.

Detailed explanation will now be made about a preferred embodiment of the present invention with reference to the enclosed figures. FIG. 1 is an enlarged plan view of a printing portion and a cutting region of a thermal printer which is used for the dual purposes of printing on a tube and of printing on a labelling sheet. FIG. 2 is an overall plan view of a printer of the present invention. FIG. 3 shows a mechanism for a completely cutting means and a driving means for the completely cutting means.

A printer 1, which constitutes an apparatus for printing on an elongated medium to be printed, is made up by integrally assembling together a display portion 2, an inputting portion 3 for inputting data by means of a keyboard, and a printing portion 4 for printing characters or the like on a tube or on a labelling tape. A labelling tape cassette 5 and an ink ribbon cassette 6 are detachably mounted on the printer 1. The labelling cassette 5 can be removed to insert therein a tube instead so that the printing on the tube can also be made.

This printer 1 employs a thermal transfer method. A thermal head 7 is provided on a head angle member (or a thermal head holder) 8. This head angle member 8 is supported at one end 8*a* thereof so as to be swingable or pivoted about a shaft of a driving roller 9. The head angle member 8 is urged or pulled by a spring 10 towards a platen roller 11. A projection 8*c* on the opposite end of the head angle member 8 is arranged to be engaged with a first cam 14 by the urging of the spring 10 as described in more detail hereinbelow.

A cam member 12 is rotatably provided on a shaft 13 and is constituted by integrally mounting together the first cam 14 and a second cam 15. The cam member 12 is rotatable in both directions of rotation by the driving of an electric motor 16.

A partially cutting means 17 serves to cut a tube or a labelling tape while leaving a part thereof uncut (or intact). It is disposed close to the second cam 15 and is made up of: a cutter holder 17*b* which is provided therein with a cutter 17*a* for cutting the tube or the labelling tape; a guide portion 17*c* which slidably guides the holder 17*b* towards, and away from, the second cam 15; and a cutter receiving block 17*d*. The holder 17*b* is urged towards the second cam 15 by an urging force of a spring (not illustrated). Therefore, the holder 17*b* slides along the guide portion 17*c* as a result of rotation of the second cam 15.

A completely cutting means 18 is located on a downstream side of the partially cutting means 17 as seen in the direction of transporting (or feeding of) the elongated medium to be printed, and serves to cut the elongated medium such as a tube, labelling tape, or the like. It is in the shape of a pair of scissors which are made up of a stationary edge 18*a* and a movable edge 18*b* which is swung or pivoted relative to the stationary edge 18*a*.

The movable edge 18*b* is connected to a projection 8*d* on the other end portion 8*b* of the head angle member 8 via a first swing lever 19, a second swing lever 20, and a connecting lever 21. As shown in FIG. 3, the first swing lever 19 is made up of a shaft 19*a* for swingably supporting the first swing lever 19, a first projecting portion 19*b* which extends in a direction along the movable edge 18*b* to support the movable edge 18*b*, and a second projecting portion 19*c* which extends in a direction substantially opposite to the direction of the first projecting portion 19*b*. To that end of this second projecting portion 19*c* which is away from the shaft 19*a*, there is connected a spring 22 so as to urge the movable edge 18*b* in a direction to be away from the stationary edge 18*a*. It is thus so arranged that the movable edge 18*b* swings relative to the stationary edge 18*a* by the swinging of the head angle member 8 as a result of rotation of the first cam 14.

The driving roller 9 is rotated by the rotation of a transporting motor 33. By the cooperation between this driving roller 9 and a roller 23 which makes a mating pair with the driving roller 9, a labelling tape 5*a* is transported or fed in the direction of an arrow "A" in FIG. 1 towards the thermal head 7.

The platen roller 11 lies opposite to the thermal head 7 and is rotated by the driving of the transporting motor 33. In cooperation with the platen roller 11 and a roller 24 which makes a mating pair with the platen roller 11, the printed labelling tape 5*a* is transported in the direction of the arrow "A" towards the partially cutting means 17. This platen roller 11 and the driving roller 9 are reversible in rotation and, therefore, the labelling tape 5*a* can be moved in the reverse direction.

A tube inserting inlet 25 is an inlet to guide the tube, after the labelling cassette 5 has been removed, into the clearance between the driving roller 9 and the roller 23 by inserting the tube thereinto.

Figure 7:
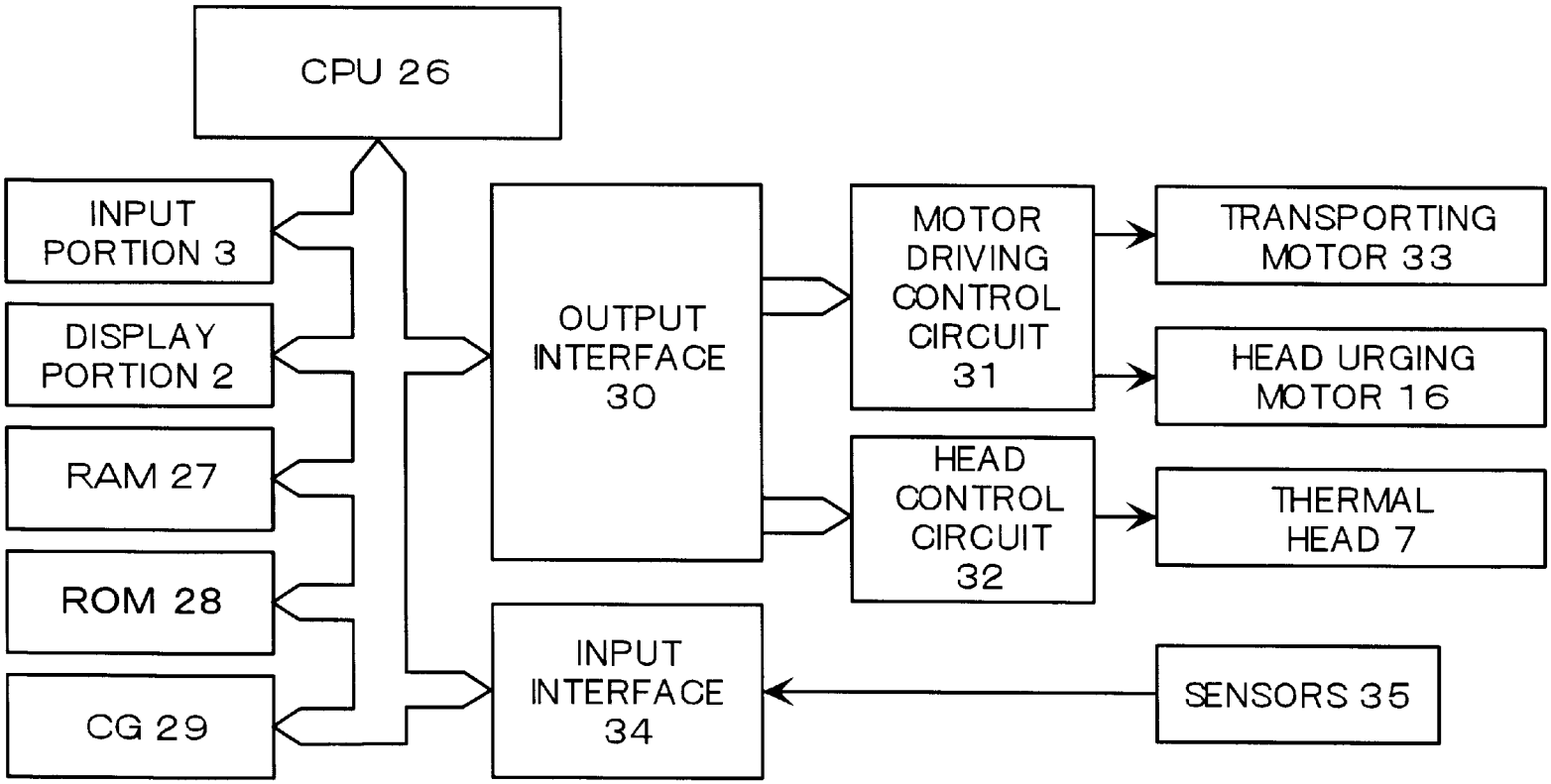
FIG. 7 is a block diagram showing the electrical arrangement of the thermal printer.

FIG. 7 is a block diagram to show an electric construction of the thermal printer 1. A Central Processing Unit (CPU) 26 is connected to the input portion 3, the display portion 2, a random access memory (RAM) 27, a read-only memory (ROM) 28, a character generator (CG) 29, an output interface 30, and an input interface 34. The CPU 26 performs a control of the entire printer based on the printing data including characters and formats inputted from the input portion 3 as well as on a control program stored in the ROM 28.

The RAM 27 performs the storing of the inputted printing data, the storing of the image data to be developed based on the printing data and the character data stored in the CG 29, and the storing of that length of the labelling tape which is equivalent to one segment of partially cut tape and that length of the completely cut tape which is equivalent to one unit of completely cut tape, both being calculated based on the printing data. In this specification, the term "segment" means a minimum piece of partially cut tape and the term "unit" means a combination of the segments (corresponding to "l" and "L", respectively, as explained in more detail with reference to FIG. 6).

An output interface 30 is connected to a motor driving control circuit 31 and a head control circuit 32. The motor driving control circuit 31 controls: the transporting motor 33 which drives the transporting roller 9, the platen roller 11, and the ink ribbon; and the head urging motor 16 which moves the thermal head 7 via the cam head 12 and drives the partially cutting means 17 and the completely cutting means 18. The head control circuit 32 controls the thermal head 7. The input interface 34 is connected to various sensors 35.

Figure 4:
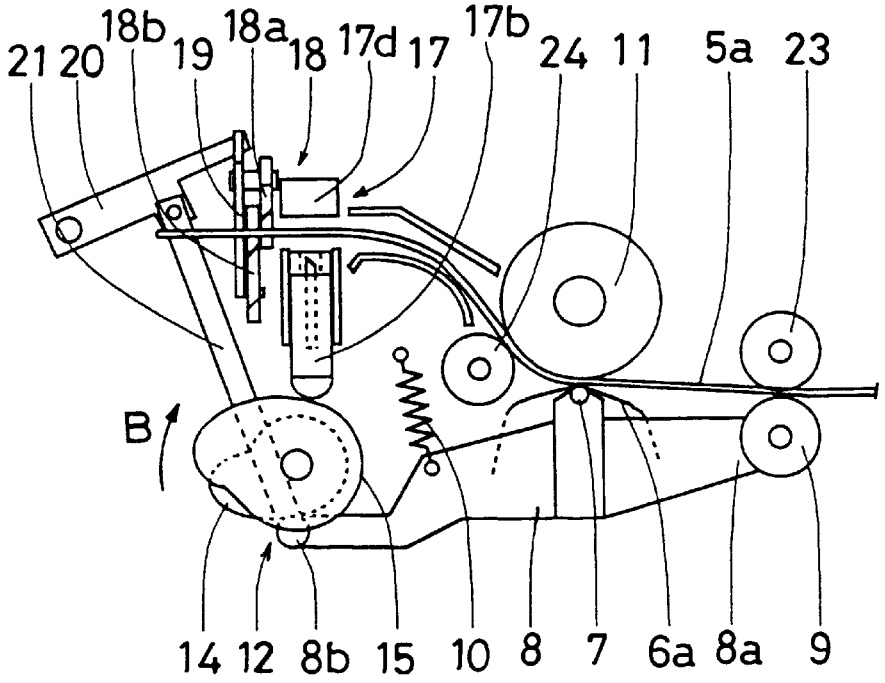
FIG. 4 is an enlarged plan view of the printing portion and the cutting region at the time of printing.
Figure 5:
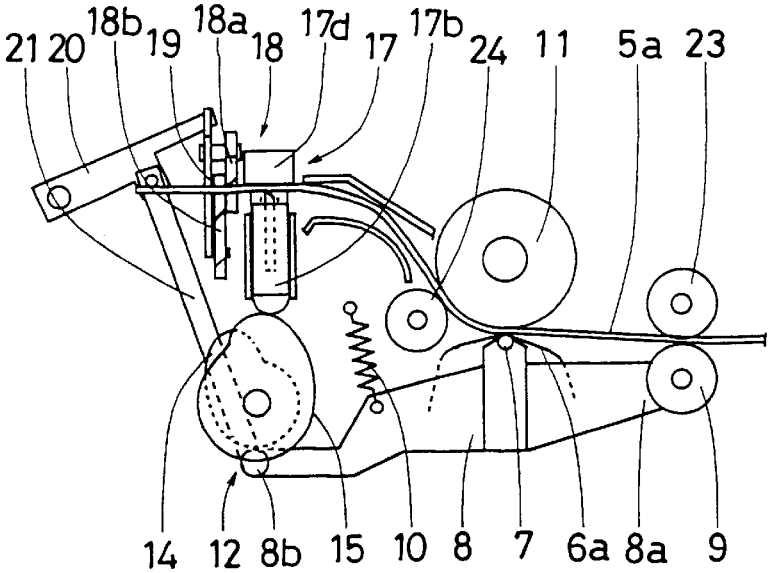
FIG. 5 is an enlarged plan view of the printing portion and the cutting region after the partial cutting.
Figure 6:
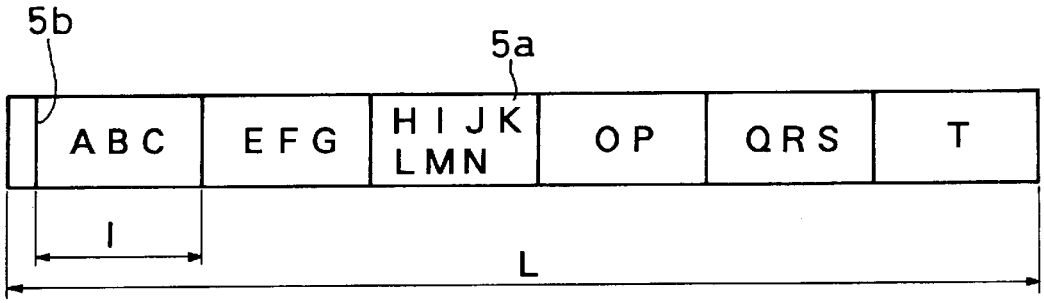
FIG. 6 is an example of printing characters.
Figure 8:
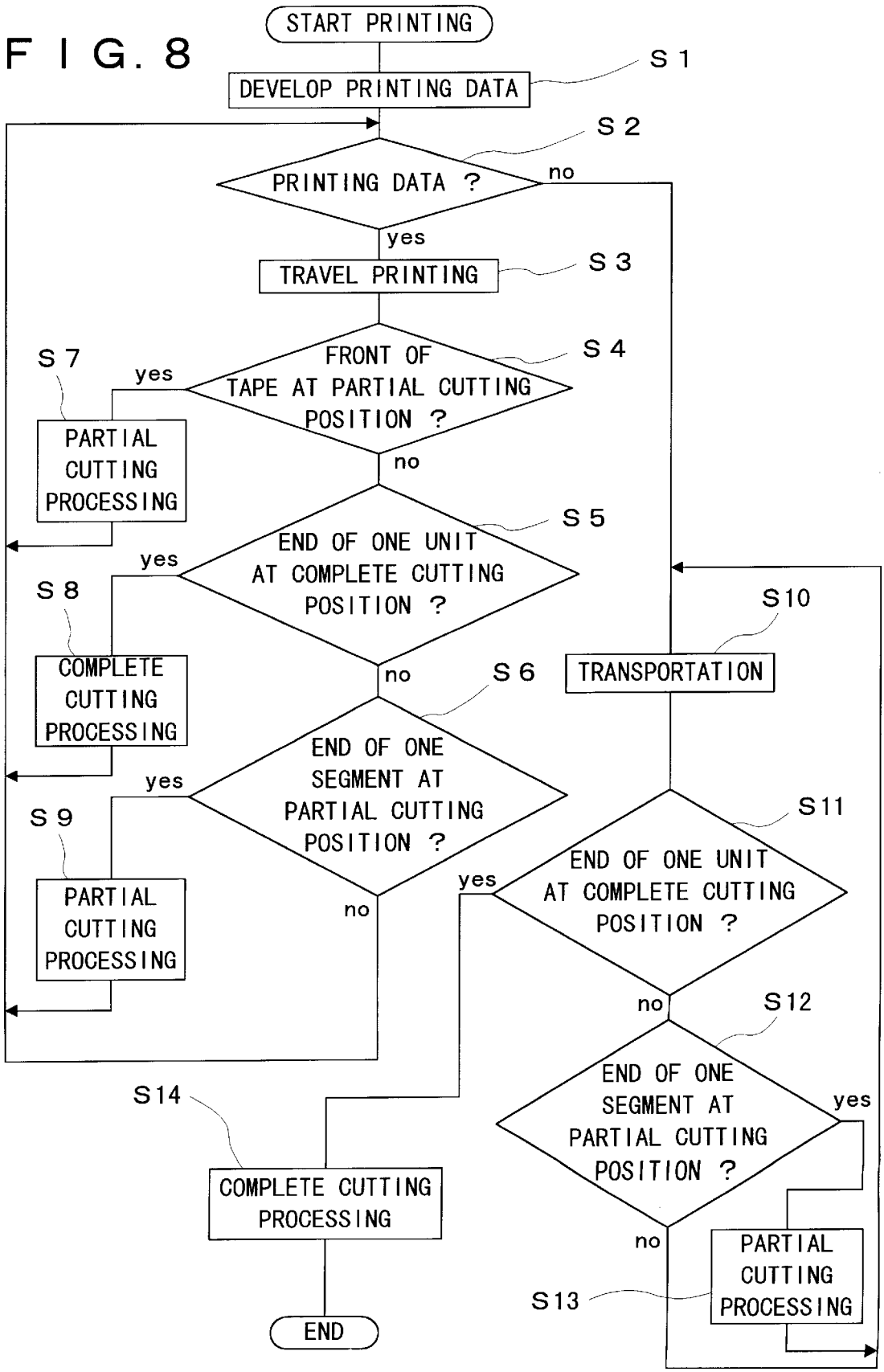
FIG. 8 is a flow chart showing the printing processing.

An explanation will now be made about the operation of the printer of the above embodiment with reference to the flow chart for printing processing as shown in FIG. 8, to the apparatus as shown in FIGS. 1, 4 and 5, as well as to the printed example as shown in FIG. 6. FIG. 1 shows a state in which the completely cutting means is being closed in a non-printing condition in which the printing has been finished. FIG. 4 shows a state in which the labelling tape is being printed. FIG. 5 shows a state in which the labelling tape is being partially cut.

First, the operator inputs the following data from the inputting portion 3 of the printer 1: i.e., the data on the characters to be printed; the data on the format such as the size of the characters, the distance between characters, the number of lines, the marginal clearances, or the like; those printing data for one unit of tape which are made up of partitioning (or segmenting) data or the like for performing partial cutting of the labelling tape into a plurality of segments for one unit; and the data on the number of units as to how many units that have the same printing data as the above are to be made or duplicated. Thereafter, if a command is given to start the printing job relating to these printing data, the printing processing is started. In this example, suppose that the printing data of the unit which is partitioned or segmented by partial cutting into six segments are inputted, and the data on the number of units to be printed are inputted as two units.

Once the printing processing is started, the inputted printing data equivalent to the two units of tapes are stored in the RAM 26 in a developed form as image data for printing. In another region of the RAM 26, based on the data on the number of characters, the size of the characters, the distance between lines, and the marginal clearances, there are obtained and stored the length l of one segment of the tape as the position of the partial cutting and the length L as the position of the complete cutting (S1). Based on the image data and the data on the tape length obtained by these printing data, the travel printing on the labelling tape 5*a* (i.e., printing on the labelling tape 5*a* while the labelling tape 5*a* is being transported or fed) is started (S2, S3).

This travel printing is performed in the following manner. Namely, the labelling tape 5*a* which is positioned as illustrated in FIG. 1 is first returned or rewound so that the front end thereof is positioned between the thermal head 7 and the platen roller 11. Then, the cam member 12 is rotated in the direction of an arrow B as shown in FIG. 1 until the front end of the labelling tape 5*a* is in the position as illustrated in FIG. 4. As a result of the above operations, the head angle member 8 is swung so that the thermal head 7 moves into contact with the platen roller 11. At the same time, the movable edge 18*b* is swung via the interconnecting lever 21, the second swing lever 20, and the first swing lever 19, so that the completely cutting means 18 is opened to thereby allow the labelling tape 5*a* to be transported or traveled. Subsequently, the labelling tape 5*a* is transported or fed in the direction of the arrow A, and the developed printing image data are supplied to the thermal head 7 to thereby print the predetermined characters on the labelling tape 5*a*.

The above-described travel printing is continuously performed until one of the following conditions is met: namely, that the partial cutting position 5*b* at the front end of the labelling tape 5*a* as shown in FIG. 6 has been transported to the partially cutting means (S4); that the end of the travelling tape equivalent to one unit based on the tape length data has been transported to the completely cutting means (S5); or that the partial cutting position which coincides with the end of one segment has been transported to the partially cutting means (S6). Once the partially cutting position at the front end of the labelling tape 5 has reached the partial cutting means, the partial cutting processing is subsequently performed (S7).

The partial cutting processing is performed in the following manner. Namely, after stopping the transporting or feeding of the labelling tape 5*a,* the cam member 12 is rotated in the direction of the arrow B until the first cam member 14 and the second cam member 15 are moved from the positions shown in FIG. 4 to the positions shown in FIG. 5. As a result of these operations, that holder 17*b* of the partially cutting means 17 which is in contact with the second cam member 15 is moved to thereby perform the partial cutting of the labelling tape 5*a*. Thereafter, the cam member 12 is reversed in rotation until the cam member 12 is in the position as shown in FIG. 4 to thereby return the holder 17*b* of the partial cutting means 17 to the non-cutting position. The partially cutting process is thus completed and the travel printing is performed again (S3).

Since the printing data in this particular case contain therein data equivalent to two units each having six segments, the travel printing is continuously performed until the printing for the two units has been completed (i.e., repetition of steps S2, S3, S4, S5 and S6). During these operations, whenever the rear end of each segment 1 of the labelling tape 5*a* which is partitioned into six segments has been transported to the partially cutting means, partial cutting processing is performed (S6, S9). Once the end of one unit of the labelling tape 5 has been transported to the complete cutting position, complete cutting work is performed (S5, S8).

The complete cutting work is performed in the following manner. Namely, the travelling of the labelling tape 5*a* is stopped first. The cam member 12 is reversed in rotation in the direction of the arrow B until the first cam 14 and the second cam 15 move from the position shown in FIG. 4 to the position shown in FIG. 1. As a result of this operation, the head angle member 8 which is in contact with the first cam 14 is swung. The thermal head 7 consequently becomes away from the platen roller 11, and the movable edge 18*b* is swung via the connecting rod 21, the second swing lever 20 and the first swing lever 19, whereby the labelling tape 5*a* is cut in cooperation with the stationary edge 18*a*. Subsequently, the cam member 12 is reversed in rotation until it is in the position shown in FIG. 4 to thereby bring the thermal head 7 into contact with the platen roller 11. The movable edge 18*b* is moved away from the stationary edge 18*a,* and the travel printing is performed again.

Once all the data on characters have been printed by repeating the travel printing work and the partial cutting work (S2), the labelling tape 5 is transported until the rear end of the second unit of the tape, which is the end of the data on printing characters, reaches the complete cutting position (repetition of steps S10, S11 and S12). During this transporting work, when the end of one segment of the labelling tape has reached the partial cutting position, partial cutting work is performed (S12, S13).

Once the end of the second unit of the labelling tape has been transported to the complete cutting position (S11), the complete cutting work is performed (S14). The complete cutting work is performed in the following manner. Namely, the traveling of the labelling tape 5*a* is stopped first. The cam member 12 is reversed in rotation in the direction of the arrow B until the first cam 14 and the second cam 15 are moved from the positions shown in FIG. 4 to the positions shown in FIG. 1. The head angle member 8 is thus swung to thereby remove the thermal head 7 away from the platen roller 11. The movable edge 18*b* is swung to thereby cut the labelling tape 5*a* in cooperation with the stationary edge 18*a*. The printing processing is finished when this complete cutting work is finished and the complete cutting edges are brought into the closed state.

In the above-described embodiment, it is so arranged that the data on the number of duplicated tapes can be inputted to enable to prepare a plurality of tapes containing the same contents therein. However, the inputting of the printing data, inclusive of the data on the number of duplicated tapes, is not limited to the mode described in this embodiment. The kinds of data to be inputted relating to the positions of the partial cutting and the complete cutting are numerous. For example, instead of the above-described arrangement, an arrangement may also be made to enable to input tape data whose contents are different from unit to unit. The present invention is to enable to perform continuous printing, partial cutting and complete cutting based on the inputted data. Therefore, the means for inputting as well as the procedure and method of inputting are not limited to the embodiment given hereinabove.

Furthermore, in this example, in order to reduce the cost, a single motor is commonly used as the driving source for the complete cutting means, for the partial cutting means as well as for the means of moving the thermal head. An independent electric motor may, of course, be employed as the driving source for each of the above means. The means for transmitting the power need not be limited to the embodiment of the present invention; instead, the power may be transmitted via other mechanisms such as gears, clutches, or the like. The methods of cutting in the complete cutting and in the partial cutting need neither be limited to the above embodiment. The arrangement or positional relationship between the complete cutting means and the partial cutting means is not limited to the embodiment of this example.

As the printing on the elongated medium to be printed, this embodiment uses the printing by means of thermal printing. However, instead of it, an ink jet printing method, magnetic printing, or the like may also be used.

According to the present invention, the apparatus for printing on an elongated printing medium to be printed has driving means for driving the completely cutting means and driving means for driving the partially cutting means. The driving means for driving the completely cutting means is so constructed and arranged to be automatically started at a complete cutting position of the medium based on a length contained in the printing data to perform complete cutting of the medium. The driving means for driving the partially cutting means is so constructed and arranged to be automatically started, independent of the complete cutting means, at a partial cutting position. Therefore, the work of printing the characters, the partial cutting work, and the complete cutting work can all be advantageously performed in an automatic manner. Further, if the inputted printing data are for making a plurality of units, the printing work for such units can be efficiently performed in a continuous manner without the need for the operator to repeat the work of starting the printing job. Further, in a preferred embodiment, the driving source for the driving means for the completely cutting means and the driving source for the driving means for the partially cutting means are constituted by a common driving source. The apparatus further comprises a switchover means for switching power transmission to each of the first transmitting means and the second transmitting means for independent driving thereof, and the driving means for driving the completely cutting means, the driving means for driving the partially cutting means, and a printing head driving means for driving a printing head towards a platen have a common diving source. Therefore, the apparatus can be simplified. Further, since the apparatus is arranged that the driving means for driving the completely cutting means closes cutting edges thereof at a time of completion of printing on the medium, the operator is protected from hurting himself by carelessly touching the blades.

It is readily apparent that the above-described apparatus for printing on an elongated medium to be printed meets all of the objects mentioned above and also has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. An apparatus for printing on an elongated medium to be printed having:

a printing head for printing based on printing data;

transporting means for transporting the medium relative to said printing head;

completely cutting means having a cutting edge for completely cutting the medium on a downstream side of said printing head, as seen in a direction of travelling of the medium;

partially cutting means having a cutting edge for partially cutting the medium on the downstream side of said printing head, wherein said apparatus comprises:

completely cutting driving means for driving said completely cutting means, so constructed and arranged to be automatically started at a complete cutting position of the medium based on a length contained in the printing data to thereby perform complete cutting of the medium; and partially cutting driving means for driving said partially cutting means, so constructed and arranged to be automatically started, independent of said completely cutting means, at a partial cutting position, said completely cutting driving means comprising a driving source and transmitting means, said partially cutting driving means comprising a driving source and transmitting means, and said driving source for said completely cutting driving means and said driving source for said partially cutting driving means being constituted by a common driving source, and wherein said apparatus further comprises transmission switchover means for separately driving said completely cutting means and said partially cutting means.

2. An apparatus according to claim 1, wherein said transmission switchover means comprises a cam member.

3. An apparatus according to claim 2, wherein said completely cutting driving means closes the cutting edge thereof at a time of completion of printing on the medium.

4. An apparatus according to claim 1, wherein said completely cutting driving means closes the cutting edge thereof at a time of completion of printing on the medium.

5. An apparatus for printing on an elongated medium to be printed having:

a printing head for printing based on printing data;

transporting means for transporting the medium relative to said printing head;

completely cutting means having a cutting edge for completely cutting the medium on a downstream side of said printing head, as seen in a direction of travelling of the medium; and partially cutting means having a cutting edge for partially cutting the medium on the downstream side of said printing head, wherein said apparatus comprises:

completely cutting driving means for driving said completely cutting means, so constructed and arranged to be automatically started at a complete cutting position of the medium based on a length contained in the printing data to thereby perform complete cutting of the medium, and partially cutting driving means for driving said partially cutting means, so constructed and arranged to be automatically started, independent of said completely cutting means, at a partial cutting position; and wherein said completely cutting driving means, said partially cutting driving means, and printing head driving means for driving a printing head towards a platen have a common driving source.

6. An apparatus according to claim 5, wherein said completely cutting driving means closes the cutting edge thereof at a time of completion of printing on the medium.

7. An apparatus for printing on an elongated medium to be printed having:

a printing head for printing based on printing data;

transporting means for transporting the medium relative to said printing head;

completely cutting means having a cutting edge for completely cutting the medium on a downstream side of said printing head, as seen in a direction of travelling of the medium;

partially cutting means having a cutting edge for partially cutting the medium on the downstream side of said printing head, wherein said apparatus comprises:

completely cutting driving means for driving said completely cutting means, so constructed and arranged to be automatically started at a complete cutting position of the medium based on a length contained in the printing data to thereby perform complete cutting of the medium;

partially cutting driving means for driving said partially cutting means, so constructed and arranged to be automatically started, independent of said completely cutting means, at a partial cutting position; and means for controlling said completely cutting means and said partially cutting means for obtaining from the elongated medium, a desired combination of a predetermined number of units of completely cut printed medium and a predetermined number of segments of half-cut printed medium, respectively.

* * * * *